US006050676A

United States Patent [19]

Sugimoto et al.

[11] Patent Number: 6,050,676

[45] Date of Patent: Apr. 18, 2000

[54] COLOR INK JET RECORDING METHOD AND APPARATUS THEREFOR

[75] Inventors: Hitoshi Sugimoto, Yokohama; Jiro Moriyama, Kawasaki; Hiroshi Tajika; Toshiharu Inui, both of Yokohama; Kiichiro Takahashi; Fumihiro Gotoh, both of Kawasaki, all of Japan

[73] Assignee: Canon Kabushiki Kaisha, Tokyo, Japan

[21] Appl. No.: 08/998,707

[22] Filed: Dec. 29, 1997

Related U.S. Application Data

[63] Continuation of application No. 08/441,994, May 16, 1995, abandoned.

[30] Foreign Application Priority Data

May 16, 1994 [JP] Japan ..... 6-101001

[51] Int. Cl.[7] ..... B41J 2/21; B41J 27/00

[52] U.S. Cl. ..... 347/43; 347/100

[58] Field of Search ..... 347/40, 43, 100, 347/12; 106/31.13, 31.151, 31.58

[56] References Cited

U.S. PATENT DOCUMENTS

| | | | |
|---|---|---|---|
| 5,225,849 | 7/1993 | Suzuki et al. | 347/14 |
| 5,371,531 | 12/1994 | Rezanka et al. | 347/43 |
| 5,395,434 | 3/1995 | Tochihara et al. | 106/31.43 |
| 5,401,303 | 3/1995 | Stoffel et al. | 347/100 |
| 5,418,277 | 5/1995 | Ma et al. | 347/100 |
| 5,477,246 | 12/1995 | Hirabayashi et al. | 347/12 |
| 5,614,931 | 3/1997 | Koike et al. | 347/43 |

FOREIGN PATENT DOCUMENTS

| | | |
|---|---|---|
| 3-146355 | 6/1991 | Japan . |

*Primary Examiner*—N. Le
*Assistant Examiner*—Thinh Nguyen
*Attorney, Agent, or Firm*—Fitzpatrick, Cella, Harper & Scinto

[57] ABSTRACT

Disclosed is a color ink jet recording method including the step of recording a desired color image on a recording medium on the basis of recording data using a black ink and a plurality of color inks each being different from the black ink in permeating characteristics against the recording medium. In this method, the surface tension is 40 dyn/cm or less for each of the inks; and the blotting factor against plain paper is 2.5 or less for the black ink, and it is in the range of from 2.5 to 3.5 for each of the color inks. Alternatively, the surface tension is 40 dyn/cm or less for each of the inks; and the permeating rate against plain paper is one second or more for the black ink, and it is less than one second for each of the color inks.

5 Claims, 8 Drawing Sheets

FIRST SCAN

SECOND SCAN

THIRD SCAN

STAGGER PATTERN

REVERSED STAGGER PATTERN

MECHANISM FOR GENERATING WHITE HAZE

COLOR INK JET RECORDING METHOD AND APPARATUS THEREFOR

This application is a continuation of application Ser. No. 08/441,994, filed May 16, 1995, now abandoned.

BACKGROUND OF THE INVENTION

1. Field of the Invention

The present invention relates to a color ink jet recording method and its apparatus for recording a clear and dense color image by discharging color inks from a recording head. In particular, the present invention concerns a color ink jet recording method and its apparatus using color inks of yellow (Y), magenta (M), cyan (C), green (G), red (R), blue (B) and the like and a black (Bk) ink.

2. Related Art

The ink jet recording method in which characters, figures and the like are recorded by discharging microdroplets of ink from discharge ports, has advantages in reducing the generation of noise, in lowering the running cost, in reducing the size of the apparatus, and in achieving the coloring. The method, therefore, has been extensively used for printers, copying machines, facsimile and the like.

In a prior art ink jet recording method, a sheet of special paper (coated paper) having an ink absorbing layer has been necessary to obtain a color image being high in color development with little bleed. Recently, a method has been practically used having a suitability for printing on sheets of commercially available "plain paper" such as high-grade/medium-grade paper and common PPC paper used for printers and copying machines in large amounts. However, in the case of color recording on a sheet of plain paper, sufficient printing quality cannot be obtained yet. In this case, the largest problem lies in that the prevention of bleed of ink between color inks used is incompatible with the insurance of the quality of black recording, particularly, the quality of black character recording.

In recent years, to form a color image with little bleed on plain paper by an ink jet recording method, a quick drying ink having a high permeating rate against plain paper has been developed. In the color ink jet recording method, color recording is performed using inks of three colors, cyan, magenta and yellow, and further, using inks of three colors, cyan, magenta, yellow, and a black ink. In the case of using the above-described inks excellent in permeability for color ink jet recording, the recorded image has high quality with little bleed between colors but is low in density as a whole, and further in the surroundings of the recording image area of each color, the ink is slightly bled along fibers of the paper (feathering), resulting in poor sharpness.

The feathering is relatively inconspicuous in a color image area; however, it is conspicuous in a black image area, thus deteriorating the recording quality. In particular, for a black character, it is poor in sharpness and unclear, resulting in the poor recording quality.

Accordingly, to obtain a high quality black color recording with reduced feathering and higher density, a black ink used for forming a black image must be of a type having a relatively low permeating rate against plain paper.

For this reason, there has been proposed an ink jet recording apparatus and its method using color inks each having a high permeating rate against paper and a black ink having a low permeating rate against paper. However, in the case of using the inks each having a high permeating rate and the ink having a low permeating rate, at the adjacent boundary portion between a black recording image area and each color recording image area, irregular blur is generated, thus significantly reducing the image quality.

The prevention of irregular blur between black and each color is incompatible with the reduction in feathering of black, and therefore, as the subject of the color recording, it has been required to simultaneously achieve the prevention of bleed and the reduction in feathering of black.

Unexamined Japanese Patent HEI 3-146355 discloses a method, wherein a recording area along the boundary area between black and each color is not recorded; however, this method is disadvantageous in that the recorded data is changed.

Another method of preventing bleed of ink in a boundary area between black and each color has been known, wherein a black area along the boundary area between black and each color is formed by overlapping of color inks. In this specification, the black color thus formed is called Process Color Bk (hereinafter, abbreviated as "PCBk").

In the method of forming the black area of PCBk along the boundary area between black and each chromatic color, it is easiest to replace all black data with PCBk data of Y, M and C. Since the PCBk is formed of only inks of Y, M and C, each of which is high in permeability, it is not bled at the boundary portion between black and each color. However, the PCBk is very different from the black color formed of the Bk ink in terms of hue, and thereby it is fringed by the boundary portion. For this reason, to adjust the hue of the PCBk, an attempt has been made to add the Bk ink in the black area formed of PCBk to some extent.

However, when an ink having a low permeability is adjacent to an ink having a high permeability, a blurry white image (in this specification, referred to as "white haze") is generated at the adjacent boundary portion, as shown in FIG. 7, which greatly exerts adverse effect on the image quality.

The "white haze" is considered to be generated by the following mechanism. The mechanism will be described with reference to FIGS. 8(*a*) to 8(*c*).

An ink having a low permeability is low in wettability against paper, and is generally high in surface tension. On the contrary, an ink having a high permeability is high in wettability against paper and is low in surface tension, and in general, it contains as an additive a surface-active agent for improving the wettability against paper. FIG. 8 shows an example wherein black ink has a low permeability and color ink has a high permeability. When an area (color ink area) recorded by the ink containing the surface-active agent for improving wettability is adjacent to an area (black ink area) recorded by the ink with no surface-active agent, as shown in FIG. 8(*a*), the surface tension of ink with no surface active agent at the adjacent boundary is lowered by the action of the surface-active agent, and further the ink with no surface-active agent is applied with internal cohesive force because of its high surface tension and tends to be moved in such a manner as to be formed in a spherical shape. Consequently, as shown in FIG. 8(*b*), the surface-active agent is spread even along the area recorded by the ink with no surface-active agent, and accordingly, when being fixed in such a state, an area with less dye is generated as shown in FIG. 8(*c*) and is recognized as the "white haze".

As a result, although the bleed of ink at the boundary area between different colors can be prevented, the image is observed as being poor by the generation of the above-described "white haze".

One example of a combination of ink compositions used in the case where the "white haze" is generated, is shown as follows:

| | | |
|---|---|---|
| 1. | Y (yellow) | |
| | C. I. Direct Yellow 86 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 2. | M (magenta) | |
| | C. I. Acid Red 289 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 3. | C (cyan) | |
| | C. I. Direct Blue 199 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 4. | Bk (black) | |
| | C. I. Direct Black 154 | 3% |
| | diethylene glycol | 10% |
| | isopropyl alcohol | 2% |
| | urea | 5% |
| | water | 80% |

Each color ink (C, M, Y) has a low surface tension of about 30 dyn/cm, and a high blotting factor against plain paper (diameter of a dot formed on a recording sheet/diameter of a discharged ink droplet) of nearly from 2.5 to 3.5, and accordingly, it is easier to be spread and slightly lowered in sharpness and to be permeated in paper. On the other hand, the Bk ink has a high surface tension of about 50 dyn/cm, and a low blotting factor against plain paper of nearly from 1.7 to 2.0, and accordingly, it is difficult to be spread and to be permeated in paper.

SUMMARY OF THE INVENTION

Accordingly, an object of the present invention is to solve the above-described problems, and to provide a color ink jet recording method and an apparatus therefor, wherein even when an image is recorded such that a black ink is adjacent to each color ink using an ink jet recording apparatus having the color inks each having a high permeability and the black ink having a poor permeability, an excellent color image recording with no "white haze" can be compatible with a black character image recording with less feathering due to prevention of bleed of ink between black and each color.

The above object can be achieved, according to a first aspect of the present invention, by provision of a color ink jet recording method, comprising the step of recording a desired color image on a recording medium on the basis of recording data using a black ink and a plurality of color inks each being different from the black ink in permeating characteristics against the recording medium, wherein the surface tension is 40 dyn/cm or less for each of the black ink and the color inks; and the blotting factor against plain paper is 2.5 or less for the black ink, and it is in the range of from 2.5 to 3.5 for each of the color inks.

According to a second aspect of the present invention, there is provided a color ink jet recording method, comprising the step of recording a desired color image on a recording medium on the basis of recording data using a black ink and a plurality of color inks each being different from the black ink in permeating characteristics against the recording medium, wherein the surface tension is 40 dyn/cm or less for each of the black ink and the color inks; and the permeating rate against plain paper is one second or more for the black ink, and it is less than one second for each of the color inks.

BRIEF DESCRIPTION OF THE DRAWINGS

FIG. 3(*b*) shows the state that dots are formed on a recording paper surface; and 3(*c*) shows the density distribution of the printing image formed on the paper surface;

FIG. 4(*a*) shows the state that ink droplets are discharged from a multi-nozzle recording head; FIG. 4(*b*) shows the state that dots are formed on the recording paper surface; and FIG. 4(*c*) shows the density distribution of the printing image formed on a paper surface;

FIG. 5(*a*) shows the state that ink droplets are discharged from a multi-head which scans by three times; FIG. 5(*b*) shows the state that dots are formed on the recording paper surface; and FIG. 5(*c*) shows the density distribution of the printing image formed on the paper surface;

FIG. 6(*b*) shows the image data arrangement upon the second scan; and FIG. 6(*c*) shows the image data arrangement upon the third scan;

FIG. 8(*b*) shows the phenomenon started to be generated by the contact of the inks; and FIG. 8(*c*) shows the state wherein the white haze is generated.

DETAILED DESCRIPTION OF THE PREFERRED EMBODIMENTS

The above-described problem can be solved, according to the present invention, by provision of a color ink jet recording method including the step of recording a desired color image on a recording medium using a black ink and a plurality of color inks each being different from the black ink in permeating characteristics against the recording medium, wherein the black ink contains a surface-active agent and lowers a permeability against paper while each of the chromatic color inks contains a surface-active agent and enhances a permeability against paper.

In the present invention, plain paper means commercially available copying paper and bond paper such as high-grade/medium-grade paper, and common PPC paper, which are used for printers and copying machines in large amounts.

In the present invention, the blotting factor of ink is calculated by dividing the diameter of a dot formed on a recording paper by the diameter of a discharged ink droplet. The calculation of the diameter of a dot formed on a recording paper and the diameter of a discharge ink droplet will be described in Example 1.

In the present invention, the wording "the permeating rate of ink is large" means the time elapsing between the instant when an ink dot is fully solid-printed on a plain paper sheet using an ink jet recording apparatus and when the ink permeates in the plain paper sheet until the brightness of the ink disappears, is short.

According to the present invention, there is also provided a color ink jet recording method including the step of recording a desired color image on a recording medium on the basis of recording data using a black ink and a plurality of color inks each being different from the black ink in permeating characteristics against the recording medium, wherein the method is performed using a multi-path recording technique in which the inks of different colors are recorded by scanning a plurality of recording heads each having a plurality of nozzles in a plurality of numbers while being thinned-out so as to be complementary to each other by each scan. In this recording method, the surface tension is 40 dyn/cm or less for each of the black ink and the color inks; and the blotting factor against plain paper is 2.5 or less for the black ink, and it is in the range of 2.5 to 3.5 for each of the chromatic color inks. Alternatively, the surface tension is 40 dyn/cm or less for each of the black ink and the color inks; and the permeating rate against plain paper is one second or more for the black ink, and is less than one second for each of the color inks.

The specific example of the multi-path recording technique will be fully described in Example 3.

The permeating characteristics of each ink in each of the above-described modes of the present invention can be adjusted by selecting the kind and/or added amount of a surface-active agent added to each ink.

Hereinafter, the present invention will be described with reference to the drawings.

Figure 1:
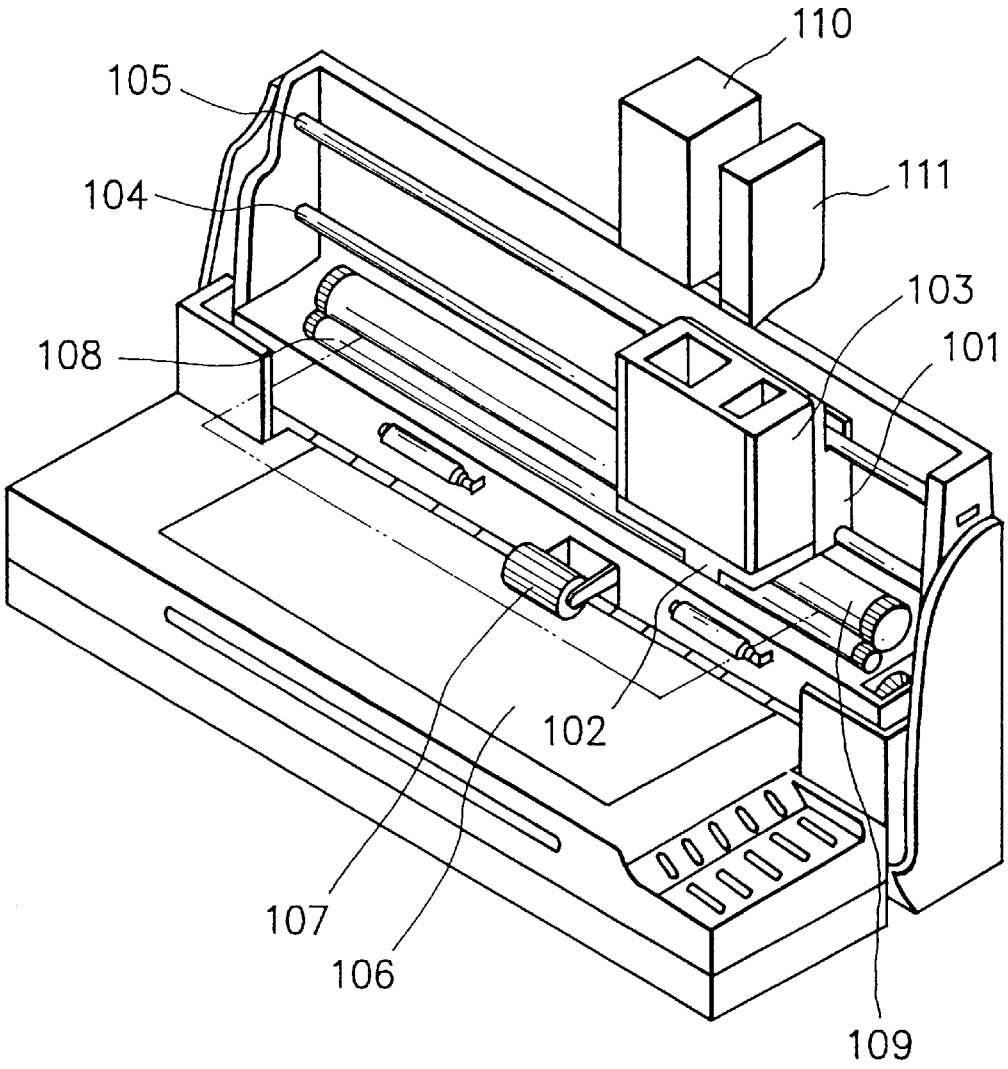
FIG. 1 is a perspective view of an ink jet recording apparatus to which the present invention is applied.

FIG. 1 is a perspective view of a recording apparatus for carrying out a color ink jet recording method of the present invention.

A carriage 101 mounts a recording head 102 and a cartridge guide 103, and is capable of scanning along guide shafts 104 and 105 (drive state: not shown).

A recording paper sheet 106 is fed in a main body of the apparatus by a feed roller 107, and it is further fed in front of a feed roller 108 while being held by the feed rollers 108 and 109, to be thus printed. Two kinds of ink cartridges, a color ink cartridge 110 containing three colors of yellow, magenta and cyan, and a black ink cartridge 111 are separately inserted in the cartridge 103 in such a manner as to be communicated to the recording head 102.

Each of the inks of yellow, magenta and cyan contained in the color ink cartridge 110 is of a type in which the permeating rate against the recording paper sheet is high for preventing the bleed of ink at the boundary of colors upon formation of a color image. On the other hand, the black ink contained in the black ink cartridge 111 is of a type in which the permeating rate against a recording paper sheet is relatively lower than that of each of the above three kinds of color inks for obtaining a high quality black image being higher in density and having less generation of feathering.

Figure 2:
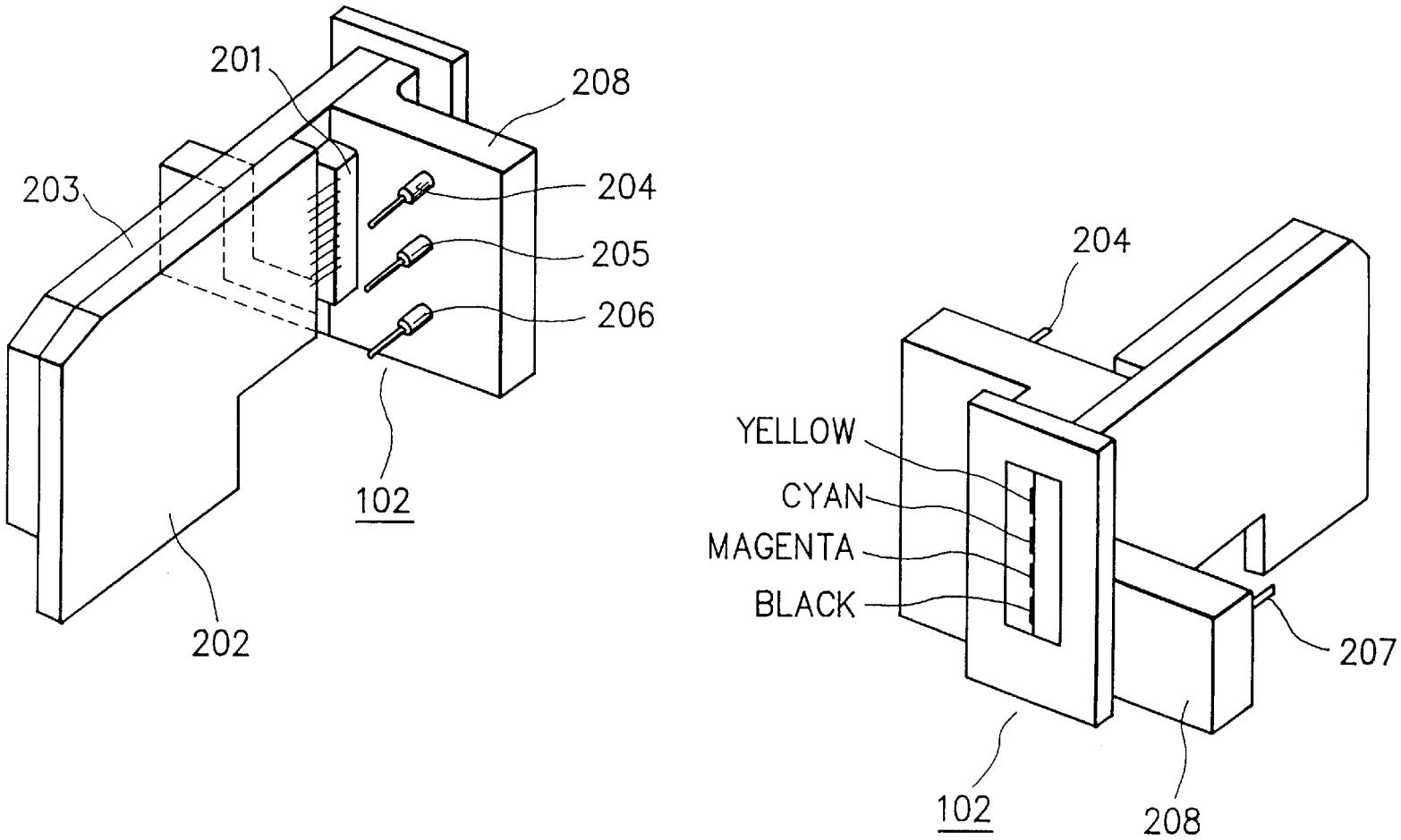
FIG. 2 is a perspective view showing the construction of a head of the ink jet recording apparatus to which the present invention is applied.

FIG. 2 is a perspective view of the recording head 102. In this figure, groups of discharge ports for yellow, magenta, cyan and black are aligned on a front surface portion of the recording head 102. Each group has 24 pieces of the discharge ports for yellow, magenta and cyan, and 64 pieces of the discharge ports for black, and the interval between colors is large than the nozzle pitch.

Each discharge port is provided with an ink liquid passage communicated to the discharge port. A common liquid chamber for supplying an ink to these liquid passages for each color is provided in the back of the portion where the ink liquid passages are disposed. In the ink liquid passage corresponding to each discharge port, an electrothermal converting body for generating thermal energy used for discharge of an ink droplet from the discharge port and electrode wiring for supplying power to the electrothermal converting body are provided. These electrothermal converting bodies (discharge heaters) and electrode wirings are formed on a substrate 201 made of silicon or the like by a film forming technique. Bulkheads, top plate made of resin or glass are laminated on the substrate, to constitute the discharge ports, ink liquid passages and common chambers, and further on the rear side thereof, a drive circuit for driving the above-described electrothermal converting bodies on the basis of a recording signal is provided in the form of a printed circuit board.

Alternatively, a grooved top plate (an orifice plate) provided with bulkheads for partitioning a plurality of ink passages and common liquid chambers may be stuck on the substrate. The grooved top plate is molded, in one body, of a common molding resin material, preferably, polysulfone.

The silicon substrate 201 and the printed circuit board 202 are provided in parallel on the same aluminum plate 203. Pipes 204 to 207 projecting in parallel to the aluminum plate 203 project from a plastic member 208 (called distributor) vertically extending from the silicon substrate, and are communicated to the internal passages of the distributor which are communicated to the common liquid chambers.

The four passages for yellow, magenta, cyan and black are provided in the distributor for connecting the common liquid chambers to the pipes.

In the example shown in FIG. 2, color ink tanks and a Bk ink tank are constructed to be independently exchanged; however, a recording head of a disposable type having a printing head integrated with the ink tanks may be used.

The present invention will be more fully described by way of the following examples. In a recording apparatus used in the examples, the resolution is 360 dots/inch, and a color ink in an amount of about 40 pl is discharged from each of the discharge ports for yellow, magenta and cyan; while a black ink in an amount of about 80 pl is discharged from a discharge port for black.

EXAMPLE 1

One example of each ink composition used in this example is shown as follows:

| | | |
|---|---|---|
| 1. | Y (yellow) | |
| | C. I. Direct Yellow 86 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 2. | M (magenta) | |
| | C. I. Acid Red 289 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 3. | C (cyan) | |
| | C. I. Direct Blue 199 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 4. | Bk (black) | |
| | C. I. Direct Black 154 | 3% |
| | diethylene glycol | 10% |
| | isopropyl alcohol | 2% |
| | urea | 5% |
| | "Acetylenol EH" (sold by Kawaken Fine Chemical) | 0.1% |
| | water | 79.9% |

As described above, each of the ink compositions of C, M, and Y was improved in permeability against paper by the addition of "Acetylenol EH" in an amount of 1%. As the additives, the other surface-active agent, alcohol and the like may be further added. Moreover, the ink compositions of C, M and Y are not particularly limited to those described above. On the other hand, the Bk ink contained "Acetylenol EH" in an amount of about 0.1%. The permeability of ink can be adjusted somewhat by adjustment of the added amount of the surface-active agent. With respect to "Acetylenol EH" which is acetylene glycol with ethylene oxide added, when it is added in an amount of about 1% or more, the permeability against plain paper is significantly enhanced; while when it is added in an amount of about 1% or less, the permeability can be adjusted in accordance with the added amount. Namely, by the addition of the surface-active agent in a small amount, it becomes possible to prepare an ink having a low surface tension and a low permeability. Additionally, in the above-described Bk ink, the surface tension was about 40 dyn/cm and the blotting factor against plain paper was nearly in the range of from 2.0 to 2.5.

The blotting factor was obtained as follows. An ink droplet was discharged on a sheet of commercially available copying paper (trade name: Canon NP DRY, XEROX 4024) or bond paper (trade name: PLOVER BOND) using the above-described recording apparatus, to form a dot. The dot thus obtained was photographed by a CCD camera, and was subjected to image processing for calculating the area of the dot converting it into a true circle. The diameter of the true circle was taken as a diameter A of the dot. On the other hand, assuming that the ink droplet is taken as a ball, a diameter B of the discharged ink droplet is calculated based on the relationship between the amount of the ink droplet ($=4/3\times\pi\times(B/2)^3$) and the diameter of the ball. The blotting factor (A/B) was thus obtained on the basis of the diameter A of the dot and the diameter B of the ink droplet.

As described above, in the ink compositions of C, M and Y, the surface tension was about 30 dyn/cm, and the blotting factor against plain paper was nearly in the range of from 2.5 to 3.5

Here, the permeating rate of ink is defined as the time elapsing between the instant when an ink dot is fully solid-printed on a plain paper sheet and when the ink permeates in the plain paper sheet (until the brightness of the liquid disappears). The permeating rate measured on the basis of the definition was less than one second for the color ink, and was one second or more for the Bk ink.

In the combination of the above-described ink compositions, the "white haze" was not recognized at the adjacent boundary surface between the Bk ink and each color ink. The reason for this is considered to be as follows. The addition of the surface-active agent to the Bk ink in a small amount is effective to weaken the internal cohesive strength of the Bk ink due to the reduction in surface tension and to make a difference in the surface tension between boundary area and inner area of the Bk ink small. It was revealed that the "white haze" can be suppressed by specifying the surface tension of the Bk ink at 40 dyn/cm or less, preferably, at 35 dyn/cm or less. In other words, when a difference in surface tension between black ink and color ink is not larger than 10 dyn/cm, preferably not larger than 5 dyn/cm, the "white haze" can be suppressed. Moreover, a high quality black character image excellent in sharpness was obtained by suppressing the blotting factor of the Bk ink at about 2.5 or less.

Specific examples of the permeating agent are Aerosol OT type permeating agents; anionic surface-active agents such as sodium dodecylbenzenesulfonate, and sodium lauryl sulfate ester; and nonionic surface-active agents such as a higher alcohol added with ethylene oxide expressed by the following equation (1), alkylphenol added with ethylene oxide expressed by the following equation (2), ethylene oxide-propylene oxide copolymer expressed by the following equation (3), and acetylene glycol added with ethylene oxide expressed by the following equation (4).

However, the anionic surface-active agent is inconvenient in handling because of a large formability and further it is inferior to the nonionic surface-active agent in terms of image characteristics such as boundary bleed, color uniformity, and feathering. Therefore, the nonionic surface-active agents expressed by the following equations are more preferable.

(1)

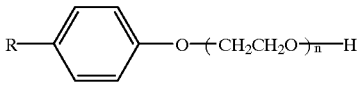

(2)

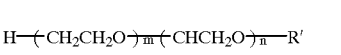

(3)

-continued (4)

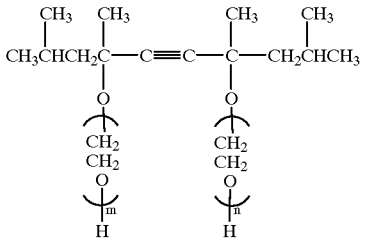

In the above-described equations, R indicates an alkyl group; R' is an alkyl group or hydrogen atom; and each of "m" and "n" is n integer.

Of the ethylene oxide type nonionic surface-active agents, the acetylene glycol added with ethylene oxide expressed by the following equation (4) is most preferable because it has a good balance of the absorbing property to an ink absorbent, image characteristics on a recording medium and discharge characteristics from the recording head. Moreover, in this compound, the hydrophilic property and permeability can be adjusted by the adjustment of the additional number (m+n) of ethylene oxide. When the number (m+n) is less than 6, the permeability is excellent but the water-solubility becomes poor, that is, the solubility to ink is poor. On the other hand, when the additional number of ethylene oxide is excessively large, the hydrophilic property is excessively larger but the permeability becomes low. When the number (m+n) is more than 14, the permeability is reduced, and the discharge characteristics are rather lowered. Accordingly, in this compound, the additional number of ethylene oxide is preferably in the range of from 6 to 14.

In the "Acetylenol EH" used in this example, the additional number (m+n) is 10.

The added amount of the nonionic surface-active agent is preferably 1 wt % or less, more preferably, 0.5 wt % or less for the Bk ink; while it is in the range of 0.5 to 20 wt %, preferably, in the range of 1 to 10 wt % for each color ink.

These nonionic surface-active agents may be used individually or in combination.

In general, the ink composition is further added with a recording agent such as dye, a low volatile organic solvent such as polyhydric alcohol for preventing clogging, and an organic solvent such as alcohol for achieving discharge stability and fixing performance on a recording medium.

The specific examples of the water-soluble organic solvents used in the present invention include a polyalkylene series such as polyethylene glycol and polypropylene glycol; an alkylene glycol series in which the alkylene group contains 2–6 carbon atoms, such as ethylene glycol, propylene glycol, butylene glycol, triethylene glycol, 1,2,6-hexatriol, hexylene glycol, and diethylene glycol; a lower alkyl ether series of polyhydric alcohol such as glycerol, ethylene glycol methyl ether, diethylene glycol methyl (or ethyl) ether, and triethylene glycol monomethyl (ethyl) ether; an alcohol series such as methyl alcohol, ethyl alcohol, n-propyl alcohol, isopropyl alcohol, n-butyl alcohol, sec-butyl alcohol, tert-butyl alcohol, isobutyl alcohol, benzyl alcohol, and cyclohexanol; an amide series such as dimethyl formaldehyde and dimethyl acetoamide; a ketone or ketone alcohol series such as acetone and diacetone alcohol; and ether series such as tetrahydrofuran and dioxane; and a nitrogen containing cyclic compound such as N-methyl-2-pyrolidone, 2-pyrolidone and 1,3-dimethyl-2-imidazolidinone. The water-soluble organic solvent may be added in the range not to deteriorate the image characteristics and discharge reliability. In particular, the polyhydric alcohol series and alkyl ether series of the polyhydric alcohol series are preferable, and the added amount thereof is preferably in the range of from 1 to 30 wt %.

The content of water in each ink is preferably in the range of from 50 to 90 wt %.

The specific examples of dyes used in the example include direct dye, acid dye, basic dye, reactive dye, disperse dye, and vat dye. The content of the dye is determined depending on the kind of the ink composition, characteristics required for ink and discharge amount of ink from a recording head; and in general, it is in the range of from 0.5 to 15 wt %, preferably, in the range of from 1 to 7 wt % on the basis of the whole weight of the ink.

It was revealed that the addition of thiodiglycol and urea (or a derivative thereof) in ink is effective to significantly improve the discharge characteristics and to significantly prevent the generation of clogging (adhesion). This is because the addition thereof improves the solubility of dye in ink. The content of thiodiglycol or urea (or a derivative thereof) is preferably in the range of 1 to 30 wt %.

As the additional ink components, a viscosity adjusting agent such as polyvinylalcohol, a cellulose group, or water-soluble resin; a pH adjusting agent such as diethanolamine, triethanolamine, or a buffer solution; and an antimold agent may be added, as needed, in the range not to obstruct the purpose of the present invention.

To prepare inks used for an ink jet recording apparatus of a type of electrifying ink, a resistivity adjusting agent including inorganic salts, such as lithium chloride, ammonium chloride and sodium chloride may be further added.

In this example, the ink jet recording method using inks of three colors, C, M and Y and a black ink has been described; however, the present invention is not particularly limited thereto, and may be applied to a color recording method using inks of a plurality of different colors, and to a recording method using inks of the same color having different dye concentration. Also, the ink composition is not limited to those described in this example.

EXAMPLE 2

One example of a combination of ink compositions used in this example is as follows:

| | | |
|---|---|---|
| 1. | Y (yellow) | |
| | C. I. Direct Yellow 86 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 2. | M (magenta) | |
| | C. I. Acid Red 289 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |

-continued

| | | |
|---|---|---|
| 3. | C (cyan) | |
| | C. I. Direct Blue 199 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 4. | Bk (black) | |
| | C. I. Direct Black 154 | 3% |
| | diethylene glycol | 10% |
| | isopropyl alcohol | 2% |
| | urea | 5% |
| | "SURFLON S-113" | 0.1% |
| | water | 80% |

As described above, even in this example, each of the ink compositions of C, M, and Y was improved in permeability against paper by the addition of "Acetylenol EH" in an amount of 1%. With respect to each of the above-described ink compositions, the surface tension was about 30 dyn/cm, the blotting factor against plain paper was in the range of 2.5 to 3.5, and the permeating rate was less than one second. The Bk ink was added with the fluorine based surface-active agent in an amount of about 0.1%. The fluorine based surface-active agent can achieve the effect in an amount smaller than that of the carbon based surface-active agent, and further it is relatively less in permeability (wettability) against paper. Consequently, an ink having a low surface tension and a low permeability can be prepared by the addition of the fluorine based surface-active agent in a small amount. Additionally, in the above-described Bk ink, the surface tension was about 20 dyn/cm, the blotting factor against plain paper was about 2.0, and the permeating rate was one second or more. The ink compositions are not limited thereto.

In combination of the above-described ink compositions, the "white haze" was not recognized at the adjacent boundary surface between the Bk ink and each color ink. The reason for this is considered to be as follows. The addition of the surface-active agent to the Bk ink in a small amount is effective to prevent the reduction of surface tension of black ink at the boundary area and weaken the internal cohesive strength of the Bk ink due to low surface tension. Moreover, the high quality black character image excellent in sharpness was obtained by specifying the blotting factor of the Bk ink against plain paper at about 2.5 or less.

In this Example, a difference in surface tension between Bk ink and color ink is 10 dyn/cm. The "white haze" is not generated even at the boundary area of the color ink because the color ink has a high permeation rate.

The specific examples of the commercially available fluorine based surface-active agents include "SURFLON S-111, S-112, S-121, S-131, S-132, S-141, S-142, and S-145 (sold by Asahi Glass); and "Fluorad FC-93, FC-95, FC-98, FC-124, FC-135, FC-170C, FC-430, and FC-431 (sold by 3M). These materials may be added individually or in combination. The fluorine based surface-active agent may be used in combination of the carbon based surface-active agent such as acetylene glycol added with ethylene oxide.

EXAMPLE 3

In an ink jet recording apparatus having a multi-nozzle recording head, there has been known a multi-path recording technique for preventing uneven image density due to variations in the discharged amounts of inks from multiple nozzles and in the discharge directions of the inks and bleed at the boundary portion between different colors. First, this technique will be described.

In contrast to the case of printing only characters by a monochrome printer, when printing a color image, various factors such as color reproduction, tone and uniformity must be adjusted. In particular, from the viewpoint of uniformity, a slight variation in size for each nozzle caused in a multi-head manufacturing process exerts an adverse effect, upon printing, on the amount of ink discharged from each nozzle and the discharge direction thereof, to generate uneven image density of the printing image, thus finally deteriorating the image quality.

Figure 3C:
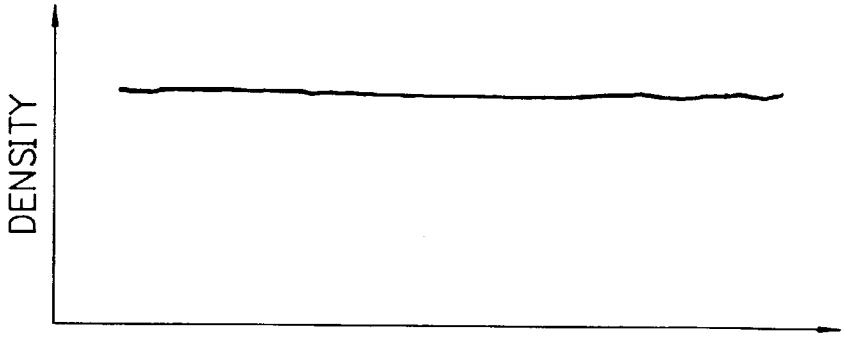
FIGS. 3(*a*), 3(*b*) and 3(*c*) are views showing an ideal printing state obtained by the ink jet recording apparatus, wherein FIG. 3(*a*) shows the state that ink droplets are discharged from a multi-nozzle recording head.
Figure 3B:
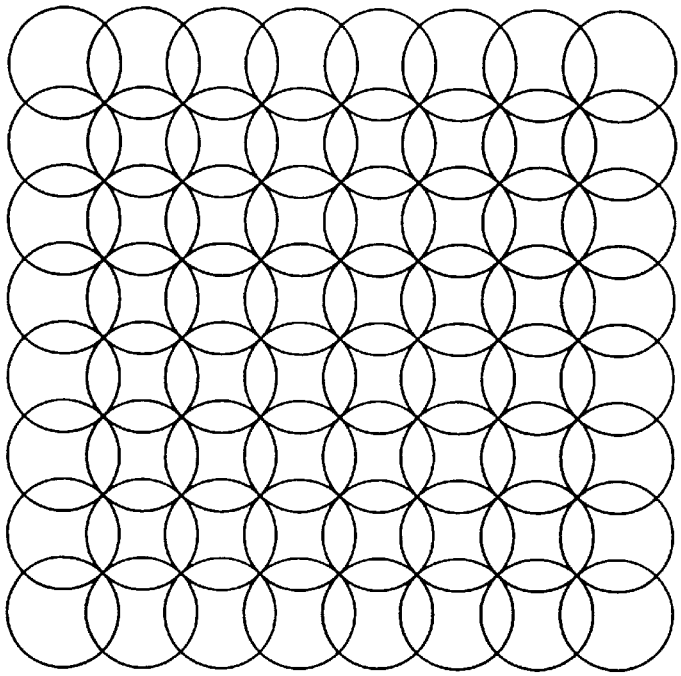
Figure 3A:
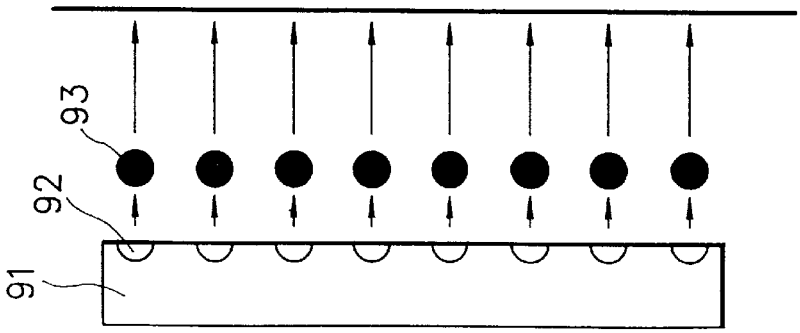
Figure 4A:
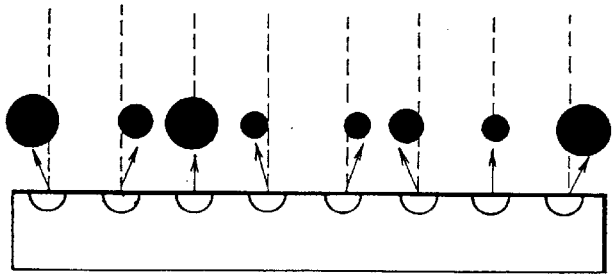
FIGS. 4(*a*), 4(*b*) and 4(*c*) are views showing a printing state having uneven image density obtained by the ink jet recording apparatus.
Figure 4B:
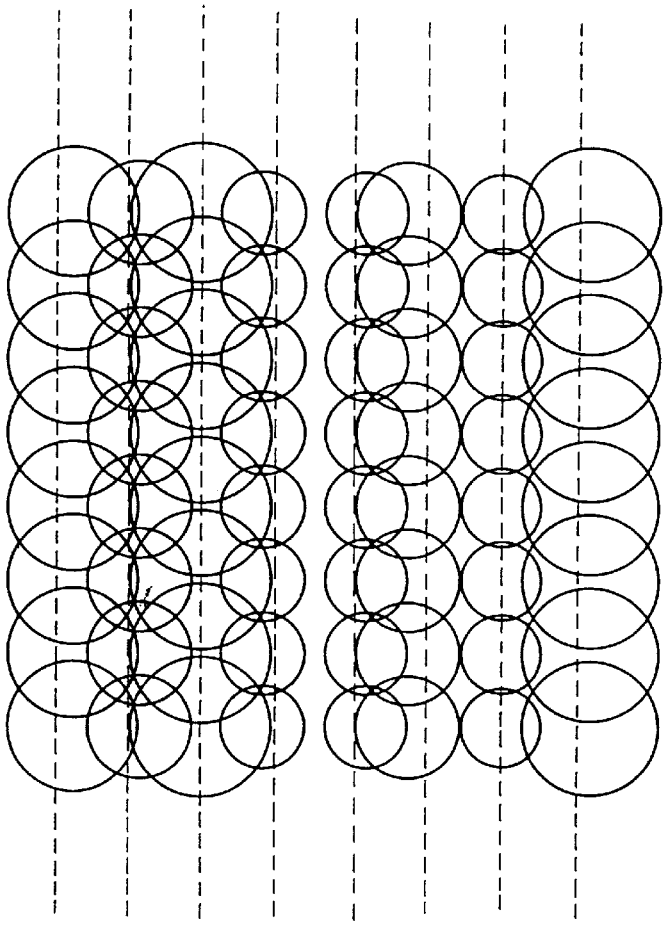
Figure 4C:
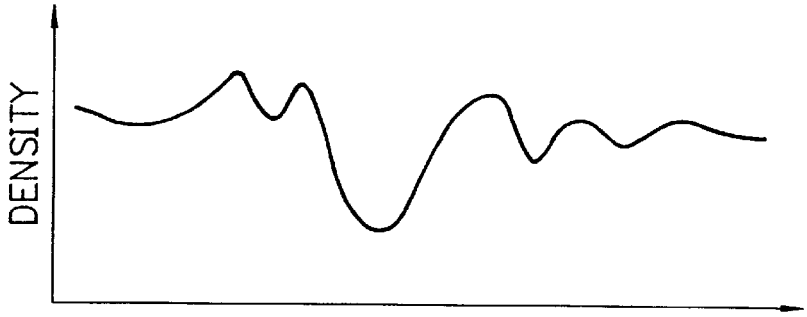

The specific example will be described with reference to FIGS. 3(*a*) to 3(*c*) and FIGS. 4(*a*) to 4(*c*). In FIG. 3(*a*), reference numeral 91 indicates a multi-head. Here, for convenience, it is assumed that the multi-head 91 has eight pieces of multiple nozzles 92. Reference numeral 93 indicates ink droplets discharged from the multiple nozzles 92. In an ideal situation, as shown in the figure, each ink in an equal amount is discharged in the same direction. In this case, each dot having an equal size is formed on a paper sheet as shown in FIG. 3(*b*), and as a whole, a uniform image without uneven image density shown in FIG. 3(*c*) can be obtained. However, actually, each nozzle has a variation in size, and accordingly, as shown in FIG. 4(*a*), each ink droplet discharged from each nozzle has variations in the size and in the direction, and is jetted on the paper sheet as shown in FIG. 4(*b*). As is apparent from this figure, with respect to a head main scanning direction, light image areas in which the area factor cannot be perfectly satisfied are periodically generated; dots are excessively overlapped; or white streaks, for example shown at the center of the figure, are generated. The group of the dots formed on the paper sheet in the above-described state exhibit a density distribution shown in FIG. 4(*c*) relative to the nozzle arrangement direction. Such an uneven density distribution is observed as the uneven image density.

Figure 5A:
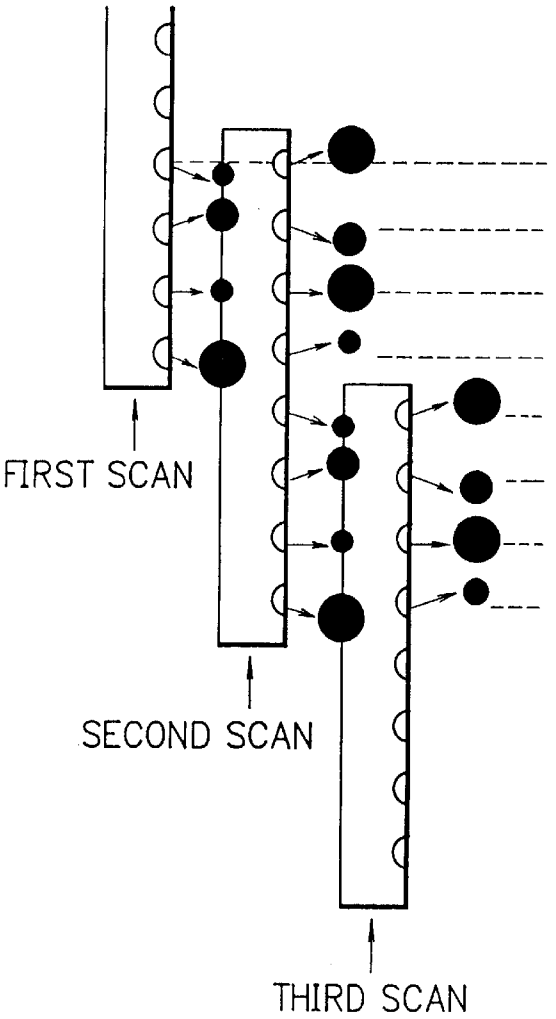
FIGS. 5(*a*), 5(*b*) and 5(*c*) are views for illustrating the reduction in an uneven image density by a multi-path recording technique.
Figure 5B:
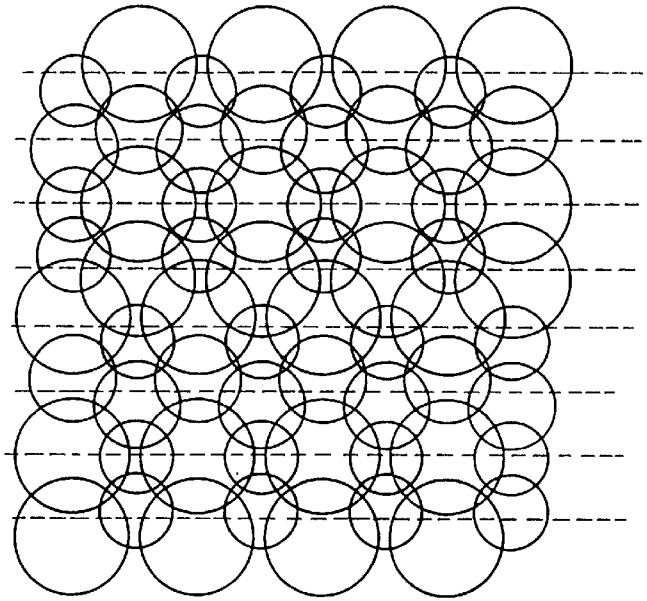
Figure 5C:
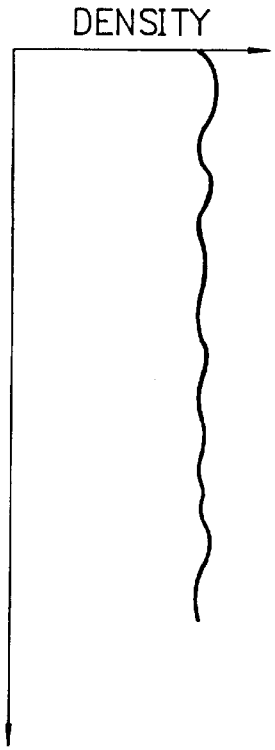
Figure 6A:
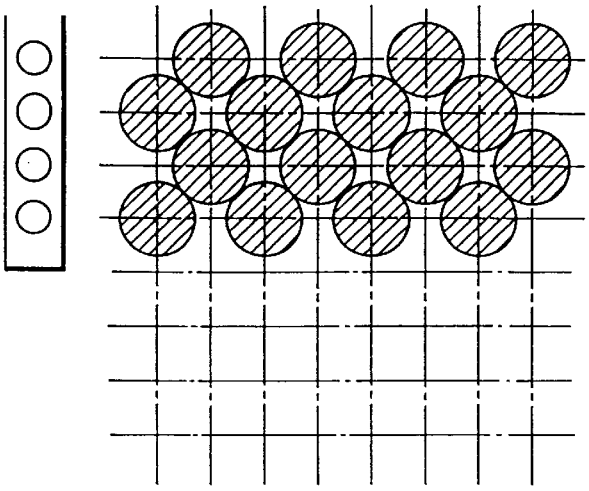
FIGS. 6(*a*), 6(*b*) and 6(*c*) are views for illustrating an image data arrangement example for reducing uneven image density by the multi-path recording technique; wherein FIG. 6(*a*) shows the image data arrangement upon the first scan.
Figure 6B:
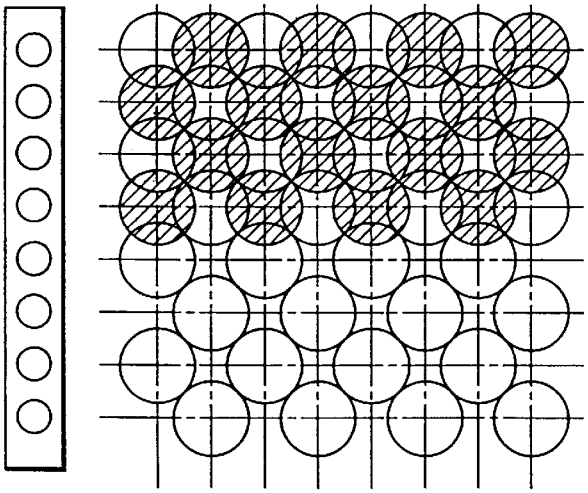
Figure 6C:
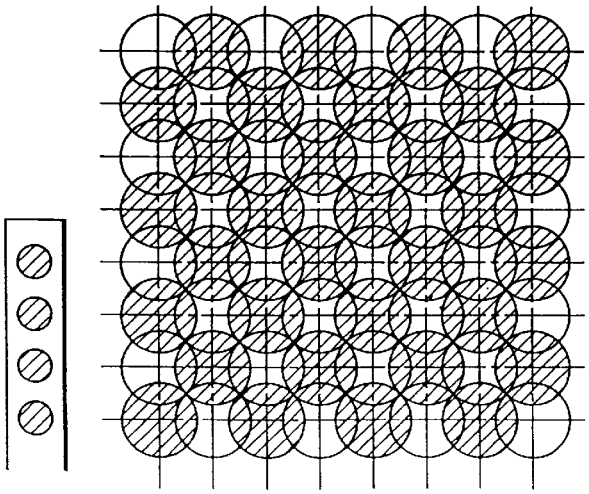
Figure 7:
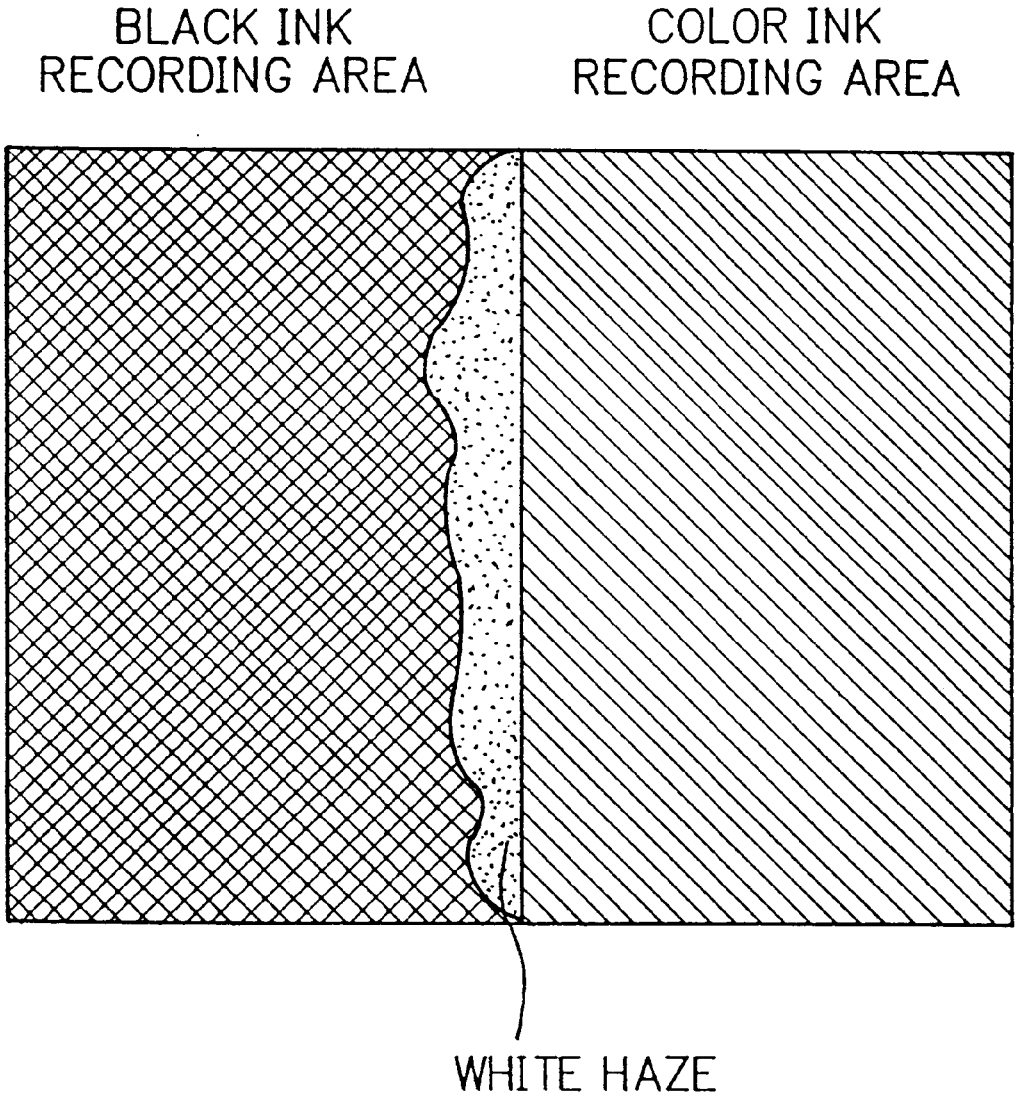
FIG. 7 PRIOR ART
FIG. 7 is a view showing a "white haze" phenomenon generated on a recording medium.
Figure 8:
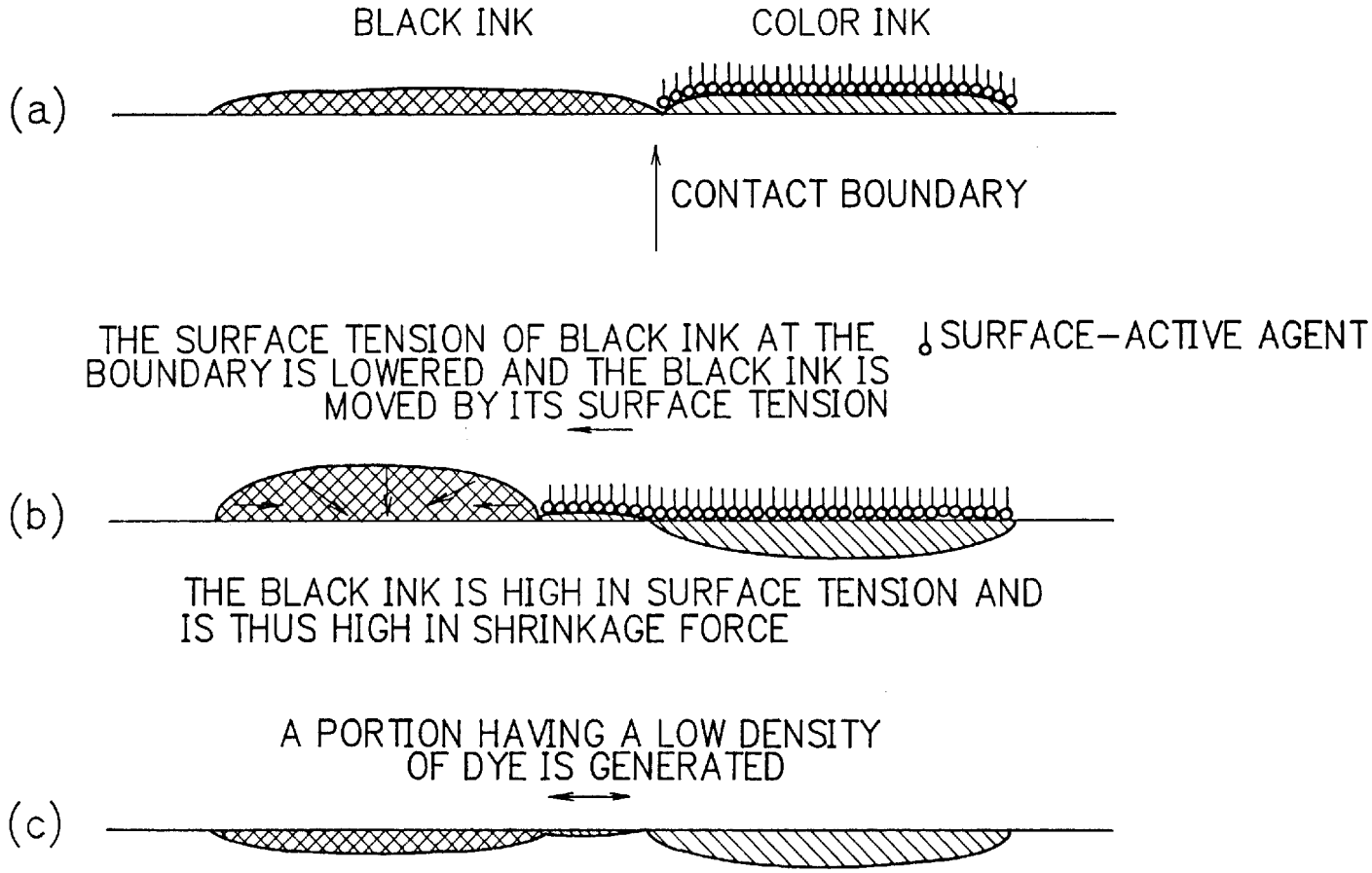
FIGS. 8(*a*), 8(*b*) and 8(*c*) are views for illustrating the mechanism generating the "white haze"; wherein FIG. 8(*a*) shows the state that a black ink with no surface-active agent is just contacted with each color ink having a surface-active agent.

To prevent the above-described uneven image density the method shown in FIGS. 5(*a*) to 5(*c*) and FIGS. 6(*a*) to 6(*c*) has been proposed. As shown in these figures, the multi-head 91 is scanned by three times for completing the printing area shown in FIGS. 3(*b*) or 4(*b*), wherein the half area of a four pixel unit is completed through two paths. In this case, the eight nozzles of the multi-head are divided into the four upper nozzles and the four lower nozzles. At the first scan, the dots printed by each nozzle are equivalent to part of the specified image data thinned-out by about half in accordance with a specified pattern arrangement, and at the second scan, the dots equivalent to the remaining half pattern are printed, thus completing the printing area of the four pixel unit. Hereinafter, this method is referred to as "division recording technique".

With this recording method, even using a multi-head having the same variation as that of the multi-head shown in FIG. 4(*a*), the effect of each nozzle on the printing image is reduced by half, thereby obtaining the printed image shown in FIG. 5(*b*), in which the black and white streaks shown in FIG. 4(*b*) become relatively inconspicuous. Consequently, as shown in FIG. 5(*c*), the uneven image density is relatively lowered as compared with the case shown in FIG. 4(*c*).

In performing the above-described recording, at the first and second scans, the pattern is divided into complementary parts in accordance with a specified arrangement. In general, the pattern arrangement (thinning-out pattern) is performed such that a stagger lattice of dots is formed at vertical and horizontal pixels as shown in FIGS. 6(*a*) and 6(*c*). Accordingly, in the unit printing area (here, a four pixel unit), the printing is completed by the first scan printing based on the stagger lattice pattern and the second scan printing based on the reversed stagger lattice pattern. FIGS. 6(*a*), 6(*b*) and 6(*c*) are views, similar to FIGS. 3(*b*), 4(*b*) and 5(*b*), for illustrating how the recording is completed by the multi-head having the eight nozzles in a specified area on the basis of the stagger lattice pattern and the reversed stagger lattice pattern. At the first scan, the recording is performed by the four lower nozzles on the basis of the stagger lattice pattern (see FIG. 6(*a*)). At the second scan, the paper is fed by the four pixels (½ of the head length) and the recording is performed on the basis of the reversed staggered lattice pattern (see FIG. 6(*b*)). Moreover, at the third scan, the paper is fed again by the four pixels (½ of the head length), and the recording is performed again on the basis of the stagger lattice pattern (see FIG. 6(*c*)). Thus, by sequentially feeding the paper sheet for each four pixels and alternately performing recording on the basis of the stagger lattice pattern or the reversed stagger lattice pattern, the recording area of the four pixel unit is completed for each scan. As described above, the printing is completed by two different nozzles in the same area, thereby making it possible to obtain a high quality image without an uneven image density.

In this example, the ink jet recording is performed using the division recording technique. A combination of ink compositions used in this example is as follows:

| | | |
|---|---|---|
| 1. | Y (yellow) | |
| | C. I. Direct Yellow 86 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 2. | M (magenta) | |
| | C. I. Acid Red 289 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 3. | C (cyan) | |
| | C. I. Direct Blue 199 | 3% |
| | diethylene glycol | 10% |
| | isopropyl alcohol | 2% |
| | urea | 5% |
| | "Acetylenol EH" (sold by Kawaken Fine Chemical) | 1% |
| | water | 79% |
| 4. | Bk (black) | |
| | C. I. Direct Black 154 | 3% |
| | diethylene glycol | 10% |
| | isopropyl alcohol | 2% |
| | urea | 5% |
| | "SURFLON S-113" | 0.1% |
| | "Acetylenol EH" | 0.02% |
| | water | 79.88% |

As described above, even in this example, each of the ink compositions of C, M, and Y was improved in permeability against paper by the addition of "Acetylenol EH" in an amount of 1%. With respect to each of the above-described ink compositions, the surface tension was about 30 dyn/cm, the blotting factor against plain paper was nearly in the range of 2.5 to 3.5, and the permeating rate was less than one second. The Bk ink was added with the fluorine based surface-active agent in an amount of about 0.1% and the "Acetylenol EH" in an amount of 0.2%. The fluorine based surface-active agent can achieve the effect in an amount smaller than that of the carbon based surface-active agent, and further it is relatively less in the permeability (wettability) against paper. Consequently, an ink having a low surface tension and a lower permeability can be prepared by the addition of the fluorine based surface-active agent in a small amount. Additionally, in the above-described Bk ink, the surface tension was about 20 dyn/cm, the blotting factor against plain paper was about 2.5, and the permeating rate was one second or more. The ink compositions are not limited thereto.

In a combination of the above-described ink compositions, "white haze" was not recognized at the adjacent boundary surface between the Bk ink and each color ink. The reason for this is considered to be as follows. The addition of the surface-active agent to the Bk ink in a small amount is effective to prevent the reduction of surface tension of black ink at the boundary area and to weaken the internal cohesive strength of the Bk ink due to low surface tension. In this Example, a difference in surface tension between Bk ink and color ink is 10 dyn/cm. Moreover, the high quality black character image excellent in sharpness was obtained by specifying the blotting factor of the Bk ink against plain paper at about 2.5 or less.

Since the amount of the ink discharged for each scan is reduced, the amount of the Bk ink adjacent to each color ink at one time is reduced, thus effectively reducing the "white haze". Accordingly, it becomes possible to prevent the bleed at the boundary between different colors and to simultaneously obtain high quality color image recording and high quality black character image recording. Moreover, the method may be performed in combination of the process Bk recording method for forming a black image area by overlapping a plurality of color ink dots (black is formed by ink dots of C, M and Y or C, M, Y and Bk).

According to the present invention, in an ink jet recording method using each color ink excellent in permeability and a Bk ink poor in permeability, the "white haze" liable to deteriorate the image at the boundary between each color image area and a black image area can be eliminated. This makes it possible to realize a high recording quality with reduced feathering in a black image area and a high recording quality without any disturbance at the adjacent surface between black and each color, and hence to simultaneously realize a high quality black recording and a high quality color recording.

We claim:

1. A color ink jet recording method for recording a desired color image on a recording medium, comprising the steps of:

providing a black ink and a plurality of color inks having a higher permeability against said recording medium than that of said black ink, wherein each of said black ink and said color inks has a surface tension of 40 dyn/cm or less; the surface tension of said black ink is greater than that of each of said color inks; and each of said black ink and said color inks contains a nonionic surface-active agent comprising acetylene glycol added with ethylene oxide; and performing recording by forming an image on said recording medium, said image having a plurality of recorded regions (a) formed from said black ink and a plurality of recorded regions (b) formed from each of said color inks, wherein said recorded regions (a) and said recorded regions (b) are adjacent to each other.

2. A color ink jet recording method according to claim 1, wherein said method is performed using a multi-path recording technique in which said inks of different colors are recorded by scanning a plurality of recording heads each having a plurality of nozzles in a plurality of numbers while being thinned-out recording data so as to be complementary to each other by each scan.

3. A color ink jet recording method according to claim 1, wherein a difference in surface tension between said black ink and each of said color inks is not larger than 10 dyn/cm.

4. A color ink jet recording method according to claim 1, wherein said black ink has a blotting factor against plain paper of 2.5 or less, and each of said color inks has a blotting factor against plain paper in a range of from 2.5 to 3.5.

5. A color ink jet recording method according to claim 1, wherein said black ink has a permeating rate against plain paper of one second or more, and each of said color inks has a permeating rate against plain paper of less than one second.

* * * * *

UNITED STATES PATENT AND TRADEMARK OFFICE

CERTIFICATE OF CORRECTION

PATENT NO. : 6,050,676
DATED : April 18, 2000
INVENTOR(S) : Hitoshi Sugimoto et al.

It is certified that error appears in the above-identified patent and that said Letters Patent is hereby corrected as shown below:

Title page,

Item [73], Assignee, insert -- [*] Notice: This patent issued on a continued prosecution application filed under 37 CFR 1.53 (d), and is subject to the twenty year patent term provisions of 35 U.S.C. 154 (a) (2) . --.

Column 8,

Line 66, "$H-(CH_2CH_2O)_m-(CHCH_2O)_n-R'$" should read $$--H-(CH_2CH_2O)_m-(\overset{\overset{\displaystyle CH_3}{|}}{CH}CH_2O)_n-R'.--.$$

Signed and Sealed this

Twelfth Day of February, 2002

*Attest:*

*Attesting Officer*

JAMES E. ROGAN
*Director of the United States Patent and Trademark Office*